US005392727A

United States Patent [19]

Christensen et al.

[11] Patent Number: 5,392,727

[45] Date of Patent: Feb. 28, 1995

[54] BALANCING SYSTEM FOR A SAILING BOAT

[75] Inventors: Jan A. Christensen, Tjodalyng; Carl O. Ohrn, Husoysund, both of Norway

[73] Assignee: Sailmatic AS, Husoysund, Norway

[21] Appl. No.: 962,787

[22] PCT Filed: Jun. 17, 1991

[86] PCT No.: PCT/NO91/00086

§ 371 Date: Feb. 8, 1993

§ 102(e) Date: Feb. 8, 1993

[87] PCT Pub. No.: WO91/19641

PCT Pub. Date: Dec. 26, 1991

[30] Foreign Application Priority Data

Jun. 15, 1990 [NO] Norway ..... 902686

[51] Int. Cl.[6] ..... B63B 15/02

[52] U.S. Cl. ..... 114/91; 114/124

[58] Field of Search ..... 114/91, 124, 39.1, 89, 114/90, 93, 121

[56] References Cited

U.S. PATENT DOCUMENTS

| | | | |
|---|---|---|---|
| 559,983 | 5/1896 | McLean | 114/91 |
| 3,903,827 | 9/1975 | Marcil | 114/143 |
| 3,985,106 | 10/1976 | Ross | 114/91 |
| 4,094,263 | 6/1978 | Marcil | 114/91 |

FOREIGN PATENT DOCUMENTS

| | | |
|---|---|---|
| 502986 | 6/1979 | Australia . |
| 456273 | 9/1988 | Sweden . |

*Primary Examiner*—Ed Swinehart

*Attorney, Agent, or Firm*—Kane, Dalsimer, Sullivan, Kurucz, Levy, Eisele and Richard

[57] ABSTRACT

A system for maintaining the hull of a sailing boat in a steady position substantially independent of wind pressures on the sail, comprising a pivoted mast and wires connecting the mast with a weight in the boat hull via a transmission device. Transverse pivoting movement of the mast causes lateral displacement of the weight thereby maintaining the hull in a stable condition.

9 Claims, 3 Drawing Sheets

BALANCING SYSTEM FOR A SAILING BOAT

BACKGROUND OF THE INVENTION

1. Field of the Invention

The present invention is related to a balancing system for a sailing boat comprising a mast tiltable laterally about the mast foot.

2. Description of the Related Art

Numerous sailing boat designs have been suggested with the above mentioned features, comprising a transversally pivotably mounted mast thereby utilizing forces transmitted from the wind forces on the sail causing the transversal mast movement in relation to the hull to angularly rotate the keel or displacing weights transversally in the hull, with the purpose such as to prevent capsizing or maintaining the hull in a substantially stable position. Sailing boats of the aforementioned art are known from e.g. U.S. Pat. Nos. 559,983, 830,720, 3,099,976 and U.S. Pat. No. 3,985,106.

From SE 456 237 is furthermore known a sailing boat in which wires attached to the mast act on hydraulic cylinders from which a hydraulic fluid of a hydraulic system is transferred to hydraulic devices adapted to transversally displace balancing weights inside the hull, preferably near the hull bottom. The hydraulic system may be set to a desired transmission ratio between the mast wire movement and the weight wire movement, e.g. a certain heeling angle of the mast is causing a desired lateral displacement of the balancing weight.

Prior art sailing boat balancing systems, however, are complex, partly comprising a large number of space consuming means, requiring hydraulic systems for the transmission of the mast movement to the weight devices and also for effecting the transversal displacement of the balancing weights.

SUMMARY OF THE INVENTION

The present invention is related to a balancing system designated to maintain the hull of a sailing boat in a desired steady position, such as horizontally, essentially independently of wind forces exerted on the sail, thereby utilizing a transversal tilting of the mast in relation to the hull of the sailboat to transversally displace a weight inside the hull by means of wires connected to the mast and the weight via at least one transmission device.

For this purpose arrangements are made for displacement of a balancing weight in the transverse direction by means of direct actuation on the weight by wires connected with the mast, in dependence of the heeling angle of the mast, in addition to which, the ratio between the lateral displacement of the balancing weight and the heeling angle of the mast may be set to a desired value. Furthermore it is required to maintain the interior of the hull free of equipment connected to the balancing system, thereby to be utilized by the sailing boat user.

With the balancing system according to the present invention the above mentioned advantages are achieved.

BRIEF DESCRIPTION OF THE DRAWINGS

In the drawing FIG. 1 discloses a vertical longitudinal center section of a sailing boat comprising one embodiment of the balancing system of the present invention, FIG. 2 discloses a cross section along II—II in FIG. 1, FIG. 3 discloses a ground view of the embodiment disclosed in FIGS. 1 and 2 of the inventive balancing system, FIG. 4 discloses cross section corresponding to FIG. 2 of a second embodiment of the present invention, FIG. 5 discloses a partial ground view corresponding to FIG. 3 of the second embodiment of the present invention, FIG. 6 discloses a partial longitudinal section corresponding to FIG. 1 of the second embodiment, FIG. 7 discloses a halc cross section corresponding to FIG. 2 of a third embodiment of the present invention, FIG. 8 discloses a partial longitudinal section corresponding to FIG. 1 of the third embodiment and FIG. 9 discloses a ground partial view corresponding to FIG. 3, of the third embodiment of the present invention.

DESCRIPTION OF THE PREFERRED EMBODIMENTS

Figure 3:
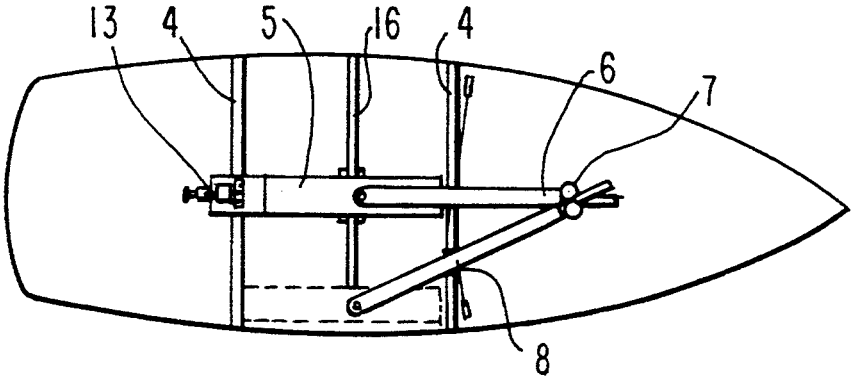

The mast 1 of the sailing boat is supported in a mast bearing 15 substantially at the deck level, allowing lateral tilting movements of the mast. Wires 2 and 3 are connected to an upper portion of the mast, preferably to a transverse stay on the mast. The wires 2 and 3 are guided downwards to guide blocks 10 at deck level and through the deck to guide blocks 9 in the interior of the hull. Between the interior blocks 9 and the transverse stays tensioning devices, such as 11 are arranged, maintaining a substantially constant prestress in the wires, thereby absorbing slack.

A balancing weight 5 is supported for transverse movement inside the hull, preferably near the bottom. The weight 5 is supported by a transversal rail 16 substantially following the cross section shape of the hull, by means of not shown rollers. Additional Guiding rollers 12 are positioned at each weight end travelling in correspondingly shaped transverse rails 4. Preferably, the Guiding rails 4 are U-shaped rails having the rollers 12 positioned between the flanges. Rail 16 and rails 4 are curved transversely in such a manner that the weight 5 may be displaced in both transversal directions in the hull with minimum friction. An appropriately curved shape of rails 16 and 4 is chosen in correspondence with the desired balancing effect in relation to the wind power and transmission ratio between the pivotal movement of the mast and the desired transversal movement of the weight. Accordingly, and as shown in the figures, weight 5 is slidingly mounted on the bottom of the hull, and is movable transversely across the bottom thereof.

Figure 2:
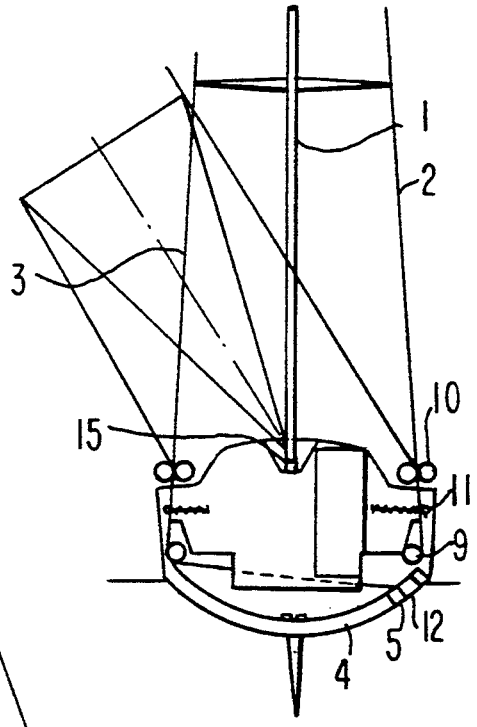
Figure 1:
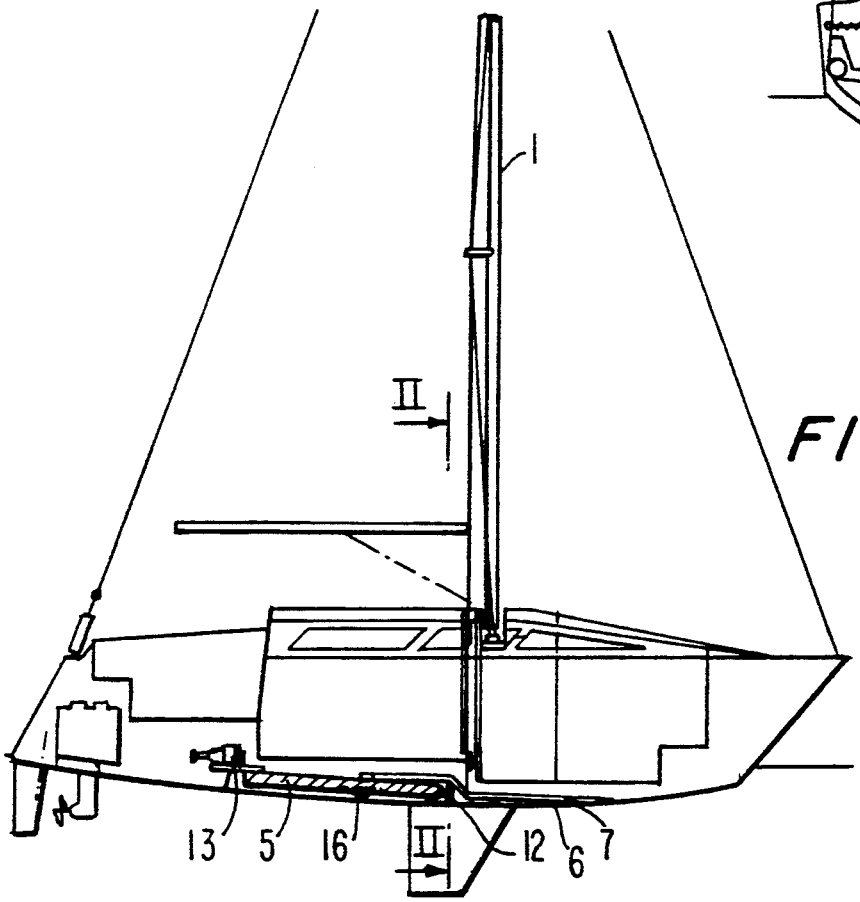

In the embodiment disclosed in FIGS. 1–3 wires 2 and 3 extend further towards the middle of the hull to a drive arm 6 to which both wires are adjustably and detachably attached, the attachment point on the arm, if desired, thereby being adjustable, thereby adjusting the distance between the arm attachment point 8 and the weight attachment point. The driver arm 6 is pivotally attached to the balancing weight 5 to allow the transversal movement of the weight.

The driver arm 6 is pivotally mounted to an arm holder member 7 allowing the arm to pivot about a vertical axis. If desired the arm holder member 7 may be adjustably secured to the hull, being displaceable in the longitudinal direction of the boat as to affect, in combination with suitable setting of the position of the wire attachment 8 to the arm, adjustment and calibration of the angular movement of the driver arm and thus the transversal movement of the weight in response to a given heeling angle of the mast 1 in relation to the hull, the end of the driver arm 6 opposite the arm holder member 7 thereby being pivotally attached to the balancing weight 5.

In order to dampen the movements of the weight, particularly result from wave influences on the hull, a hydraulic braking device 13 may be secured to the weight 5. The braking device comprises a gear transmission of which a gear engages a toothed rack attached to the rear rail 4 thereby dampening a transversal weight movement. The braking effect of the braking device 13 may be set hydraulically for adaptation to the prevailing conditions.

Wind forces acting on the sail will rotate the mast 1 about its bearing 15 as disclosed in FIG. 2, pulling the wire 2 upwards, slackening the wire 3 and allowing it to be pulled downwards thereby rotating the drive arm 6 its vertical axis in the arm holder member 7, thereby displacing the weight 5 laterally in such a manner that the wind force transmitted via the wires is counteracted by a corresponding oppositely directed resultant force from the weight 5. The displacement of the weight 5 causes the driver arm 6 to move longitudinally inside the arm holder member 7 thereby to establish a longer driver arm 6 allowing the weight to move strictly transversally in the hull. The weight 5 is displaced on rails 16 and guided by means of the rollers 12 at minor friction forces due to the precise guidance of the weight 5 by the guide rollers 12 in rails 4 as well as the guidance on the rail 16.

The object of the invention is to maintain the hull in the desired position, e.g. in a horizontal position, essentially independently of the wind forces on the sail and thus on the mast 1.

When the wire 2 is made taut as a consequence of the mast movements the leeward wire 3 will slacken but this slackening will immediately be absorbed by the tensioning device 11. The tensioning device 11 ensures that the wire constantly is maintained prestressed or biased.

The ratio of the mast heeling angle and consequently the prolongation of the wire 2 to the movement of the weight 5 in relation to the center plane of the hull, may be adjusted by changing the position of the attachment of the wires 2 and 3 to the driver arm 6 along the lengthwise direction of the arm in such a manner that the distance from said attachment 8 to the pivot axis of the arm holder member 7 may be altered. The extent of the angular displacement of the driver arm as a result of an angular displacement of the mast 1 therefor is depending on the angle position of the driver arm from the hull center line. The tensioning devices 11 automatically adjust the degree of wire tightness.

A further possibility of adjustment of or changing the relationship between the mast tilting angle and the movement of the weight may be achieved by displacing the arm holder member 7 in the longitudinal direction of the hull such that the center of the turning movement of the drive arm 6 is altered.

The various possibilities of adjustment, such as the attachment 8 of the wires to the driver arm and the positions of the arm holder member 7, allow adaptation of the system to the desires and needs of the sailor with regard to the specific hull design and expected wind and sea conditions.

Additionally, a further possibility of adjustment exists on account of the damping effect exerted by the hydraulic dampening motor unit 13 on the movements of the weight 5, which motor is provided particularly with a view to dampen weight motions caused by waves.

Figure 4:
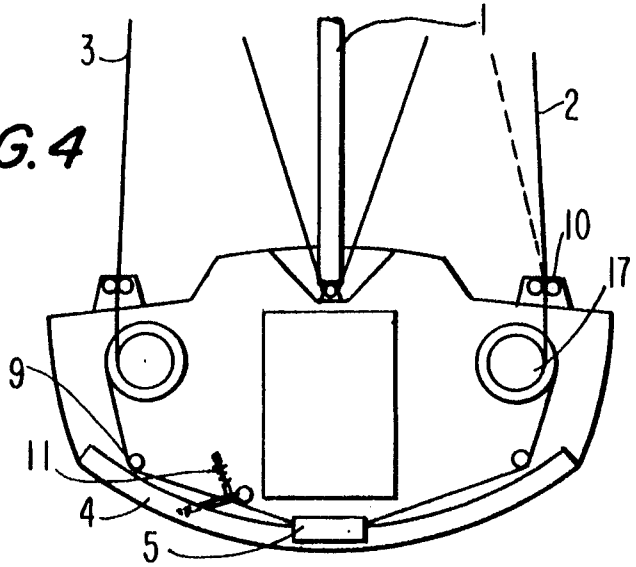
Figure 5:
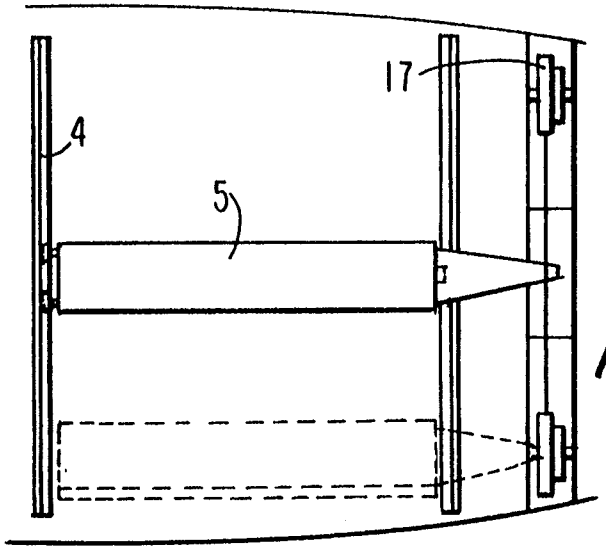
Figure 6:
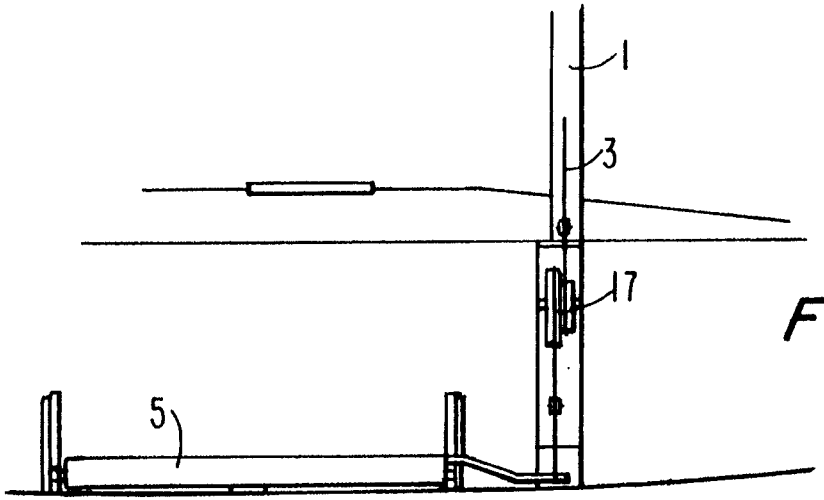

FIG. 4 through 6 illustrate a modification of the balancing system according to the present invention. As in the previously described embodiment, the weight 5 is supported on rail 16 and guided in rails 4 by suitable rollers.

Transfer of the mast tilting movements for effecting lateral displacement of the weight 5 is however in a second embodiment effected by a transmission device comprising at least one transmission block 17, which may even be adjustable. The transmission ratio of the block 17 normally will be chosen for a certain sailing boat by the diameter of the wheel for the incoming wire 2 from the mast in relation to the diameter of the outgoing wheel for the wire to the weight. As in the previous described embodiment the wires 2 and 3 are biased by tensioning devices 11, one of which being disclosed in FIG. 4. Also this embodiment of the invention obviously may be equipped with a hydraulic dampening motor, not illustrated in the drawings.

Figure 7:
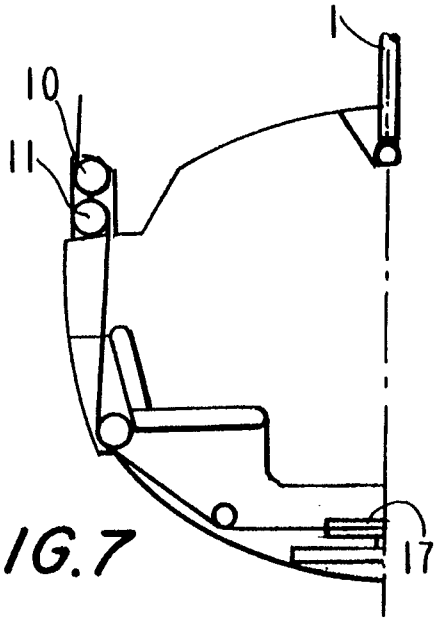
Figure 8:
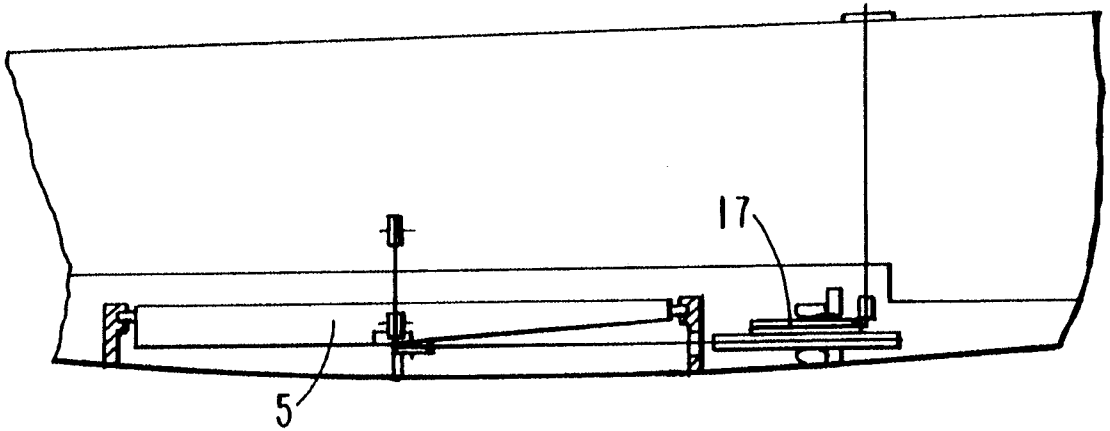
Figure 9:
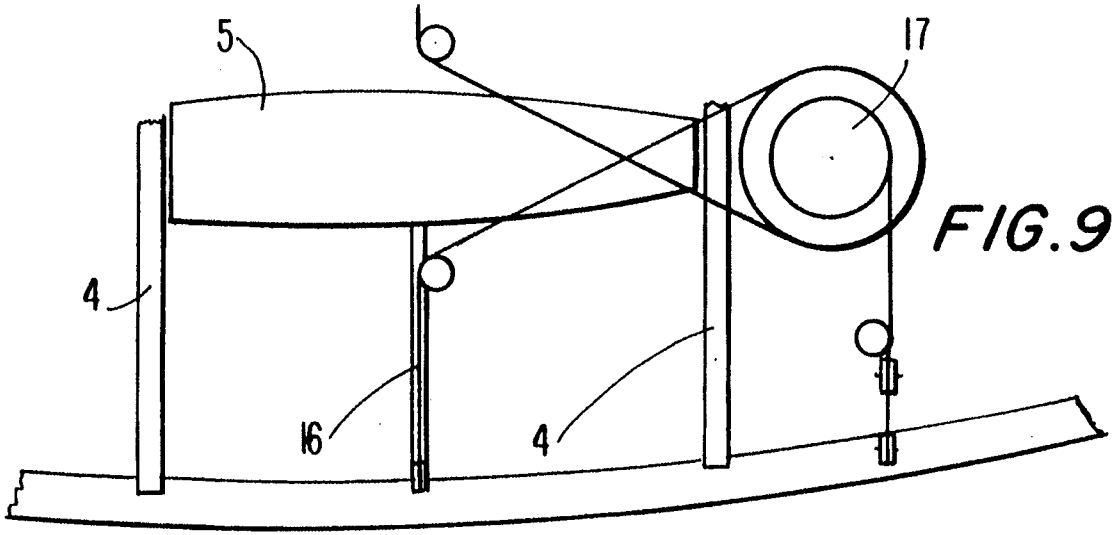

FIGS. 4–6 disclose a second embodiment comprising two transmission blocks 17 arranged one on each side of the center axis, preferably underneath the guiding blocks 10. FIGS. 7–9 disclose a third embodiment comprising only one transmission block 17 being arranged at a level in the hull substantially corresponding with the weight level, thereby providing a hull the interior of which not being occupied by means connected with the balancing system.

The transmission block or blocks 17 may consist simply of two wheels having different radii and having a common shaft to which both wheels are rigidly secured. The transmission blocks also may be of a type comprising a series of wheels having different radii, wheels of conical periphery comprising helical grooves therein or any form of infinitely variable pulley mechanism thereby to provide a transmission block type with a variable transmission ratio.

From the two transmission blocks 17 of the second embodiment or the single block 17 of the third embodiment the left and right wires are guided via pulleys to be connected preferably to the middle of the weight 5, above the rail 16.

The third embodiment comprises, as disclosed in FIG. 7, tensioning devices 11 included in the guide blocks 10.

We claim:

1. A balancing system for a sailing boat, said sailing boat having a hull, said hull having a first and a second side, comprising:

a mast pivotally attached to said sailing boat and tiltable transversely with respect to said hull;

a weight within said hull, said weight being slidingly mounted on the bottom of said hull and movable transversely across the bottom thereof;

a first wire and a second wire, each of said wires having a first and a second end, said first end of each of said wires being attached to said mast;

a first guide block and a second guide block, said first and second guide blocks being on said first and second sides of said hull, respectively, said first and second wires passing around said first and second guide blocks, respectively, and into said hull; and means within said hull for transmitting a transverse tilt of said mast to said weight, said second ends of said wires being attached to said means, said means being operably connected to said weight, so that a transverse tilt of said mast in one direction may cause a transverse movement of said weight in the opposite direction, whereby said sailing boat may be maintained in a stable condition, wherein said transmitting means comprises a first and a second transmission block on said first and second sides of said hull, respectively, and a weight wire, each of said first and second transmission blocks having a first and a second wheel, said second ends of said first and second wires being attached to said first wheels of said first and second transmission blocks, respectively; and said weight wire having a first end, a middle and a second end, said first end of said weight wire being attached to said second wheel of said first transmission block, said middle of said weight wire being attached to said weight, and said second end of said weight wire being attached to said second wheel of said second transmission block.

2. A balancing system as claimed in claim 1 further comprising a first and a second tensioning device for said first and second wires, respectively, said tensioning devices being constantly biased to eliminate slack from said first and second wires.

3. A balancing system as claimed in claim 1 further comprising a tensioning device for said weight wire, said tensioning device being constantly biased to eliminate slack from said weight wire.

4. A balancing system as claimed in claim 1 wherein said first and second wheels of said first and second transmission blocks have diameters different from one another.

5. A balancing system for a sailing boat, said sailing boat having a hull, said hull having a first and a second side, comprising:

a mast pivotally attached to said sailing boat and tiltable transversely with respect to said hull;

a weight within said hull, said weight being slidingly mounted on the bottom of said hull and movable transversely across the bottom thereof;

a first wire and a second wire, each of said wires having a first and a second end, said first end of each of said wires being attached to said mast;

a first guide block and a second guide block, said first and second guide blocks being on said first and second sides of said hull, respectively, said first and second wires passing around said first and second guide blocks, respectively, and into said hull; and means within said hull for transmitting a transverse tilt of said mast to said weight, said second ends of said wires being attached to said means, said means being operably connected to said weight, so that a transverse tilt of said mast in one direction may cause a transverse movement of said weight in the opposite direction, whereby said sailing boat may be maintained in a stable condition, wherein said transmitting means comprises a transmission block and a weight wire, said transmission block having a first and a second wheel, said second ends of said first and second wires being attached to said first wheel of said transmission block; and said weight wire having a first end, a middle and a second end, said first and second ends of said weight wire being attached to said second wheel of said transmission block, and said middle of said weight wire being attached to said weight.

6. A balancing system as claimed in claim 5 further comprising a tensioning device for said weight wire, said tensioning device being constantly biased to eliminate slack from said weight wire.

7. A balancing system as claimed in claim 5 wherein said transmission block is mounted on said bottom of said hull adjacent to said weight.

8. A balancing system as claimed in claim 5 wherein said first and second wheel of said transmission block have diameters different from one another.

9. A balancing system as claimed in claim 5 further comprising a first and a second tensioning device for said first and second wires, respectively, said tensioning devices being constantly biased to eliminate slack from said first and second wires.

* * * * *